United States Patent [19]

Schneider et al.

[11] 3,969,979

[45] July 20, 1976

[54] LIQUID PROPELLANT FOR A GUN

[75] Inventors: Abraham Schneider, Overbrook Hills, Pa.; Stanley E. Wood; James T. Bryant, both of Inyokern, Calif.

[73] Assignees: Sun Ventures, Inc., St. Davids, Pa.; The United States of America as represented by the Secretary of the Navy, Washington, D.C.

[22] Filed: July 29, 1975

[21] Appl. No.: 600,016

[52] U.S. Cl. ..... 89/7; 149/74

[51] Int. Cl.[2] ..... F41F 1/04

[58] Field of Search ..... 149/74, 87; 89/7

[56] References Cited

UNITED STATES PATENTS

| | | | |
|---|---|---|---|
| 2,129,875 | 9/1938 | Rost | 89/7 |
| 2,970,899 | 2/1961 | Ryker | 89/7 |
| 3,470,040 | 9/1969 | Tarpley | 149/74 X |
| 3,661,659 | 5/1972 | Breza | 149/74 X |
| 3,704,184 | 11/1972 | Kuehl et al. | 149/74 X |
| 3,883,376 | 5/1975 | Billig et al. | 149/87 X |
| 3,888,159 | 6/1975 | Elmore et al. | 89/7 |

*Primary Examiner*—Edward A. Miller

*Attorney, Agent, or Firm*—J. Edward Hess; Donald R. Johnson; Anthony Potts, Jr.

[57] ABSTRACT

An improvement to a liquid propellant gun system wherein a hydrocarbon used in conjunction with nitric acid is predominantly the exo form of tetrahydrodicyclopentadiene and/or its methyl or dimethyl or ethyl derivatives or a mixture thereof. Other suitable hydrocarbons are as follows: a mixture of trans-syn-2-methyldecalin and trans-anti-1-methyldecalin, trans-perhydroacenaphthene and perhydrofluorene.

3 Claims, 2 Drawing Figures

LIQUID PROPELLANT FOR A GUN

BACKGROUND OF THE INVENTION

This invention is directed towards an improvement in a liquid propellant gun system. More particularly it is directed towards the liquid propellant used with such a system. It is directed toward the hydrocarbon used with other components of the liquid propellant.

In a liquid propellant gun, hereinafter referred to as LPG, system a liquid supplies energy to drive the projectile forward. This is in contrast to the solid, e.g., gunpowder, or nitrocellulose-based and other smokeless propellants used in a conventional gun. The liquid used in LPG is a combination of several components. Generally a liquid hydrocarbon and nitric acid are the components. Thus the combination can be referred to as bipropellant. Just prior to ignition, the bipropellant is an emulsion.

A LPG system generally operates as follows. The projectile is inserted in the barrel of a gun and its fit is such that it forms a liquid tight seal. A bolt and injection nozzle are located behind the projectile when it is in position. Nitric acid and hydrocarbon are simultaneously mixed and injected into the chamber, i.e., the space between projectile and the bolt. After the chamber is filled with the bipropellant, the bolt moves forward and seals the injection nozzle. A spark ignition device is used to generate a spark which ignites the bipropellant. The spark device can be located in the bolt or elsewhere.

Hydrocarbons such as n-octane have been tried and found not totally satisfactory. More recently a mixture of endo and exo tetrahydrodimethyldicyclopentadienes has been used. A mixture of the foregoing is often referred to as a TH-dimer. However, the TH-dimer has deficiencies. For example, TH-dimer upon mixing with aqueous nitric acid undergoes nitration at ambient temperature with evolution of considerable heat.

Surprisingly applicants have discovered that if, for example, the hydrocarbon used contains a majority of the exo form of several hydrocarbons the foregoing premature nitration problem does not exist. Also, other types of hydrocarbons were also found to be usable.

A method for preparing tetrahydrodicyclopentadienes is disclosed in U.S. Pat. No. 3,381,046, Apr. 30, 1968 and JOURNAL OF THE AMERICAN CHEMICAL SOCIETY, Vol. 82, 1960, pages 4645–4651. Methods of preparation for the other hydrocarbons found suitable are known to those skilled in the art.

SUMMARY OF THE INVENTION

In a LPG system certain hydrocarbons and mixtures thereof have utility as the hydrocarbon portion of the bipropellant. These hydrocarbons are:

a. exo-tetrahydrodicyclopentadiene;
b. a mixture of a major amount of (*a*) and a minor amount of its endo form;
c. exo-tetrahydrodimethyldicyclopentadiene;
d. a mixture of a major amount of (*c*) and a minor amount of its endo form;
e. exo-tetrahydromethyldicyclopentadiene;
f. a mixture of a major amount of (*e*) and a minor amount of its endo form;
g. exo-tetrahydroethyldicyclopentadiene;
h. a mixture of a major amount of (*g*) and a minor amount of its endo form;

i. a mixture of trans-syn-2-methyldecalin and trans-anti-1-methyldecalin;
j. trans-perhydroacenaphthene;
k. perhydrofluorene; and
l. a mixture of any of the foregoing.

DESCRIPTION OF THE INVENTION

Figure 1:
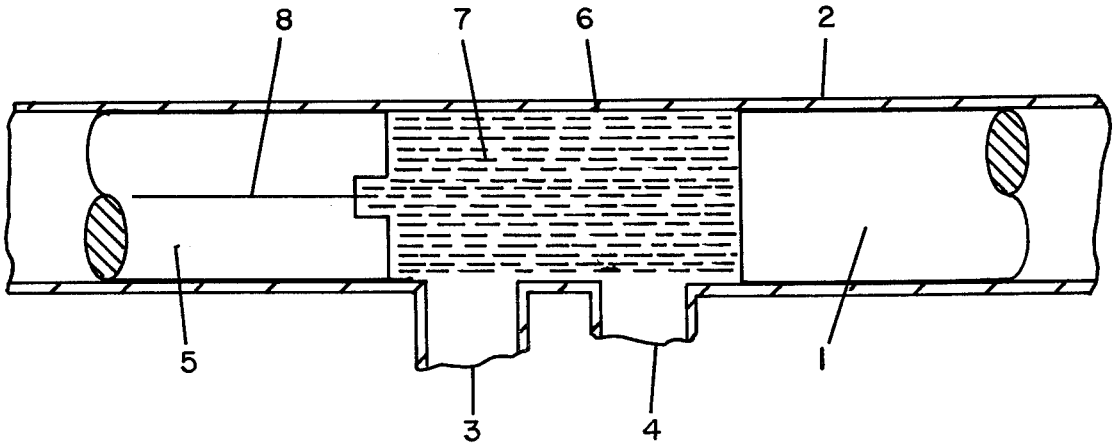
FIG. 1 is a schematic drawing which shows the position of the various parts of a LPG system during the injection of the bipropellant.
Figure 2:
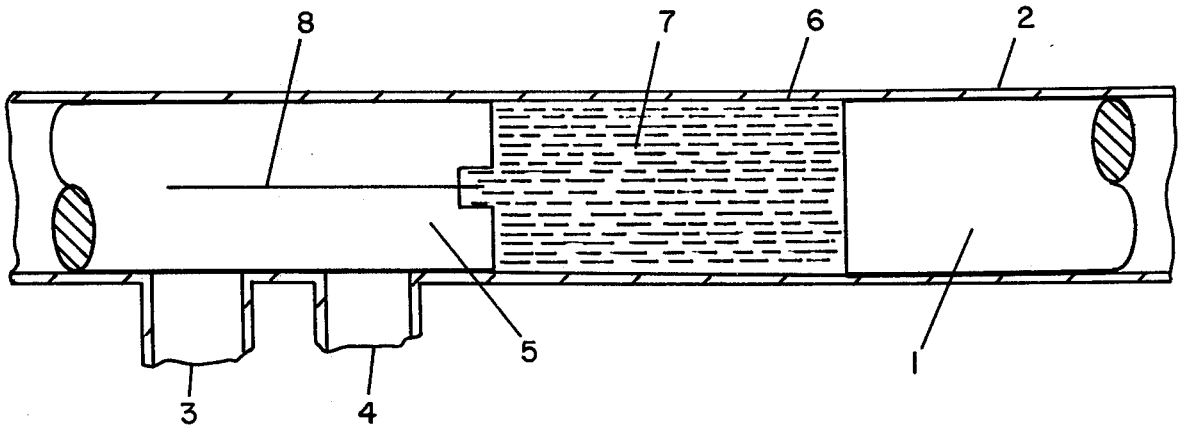
FIG. 2 shows the LPG system after the injection of the bipropellant and just prior to the ignition of the bipropellant.

The way the LPG system generally operates is as follows. FIGS. 1 and 2 help describe the sequence of steps. The projectile 1 is placed in the barrel 2 and forced into its proper position. FIG. 1 shows the relative position of the projectile to the injection nozzles 3 and 4 and the bolt 5. Other relative positions are operative. Through nozzles 3 and 4 acid and hydrocarbon are separately injected into chamber 6. In this illustration only two nozzles are shown and the components are injected separately. Other alternatives are feasible; thus premixing of the acid and hydrocarbon would be operative. Also, more than two nozzles can be used, and other relative locations are permissible. In the chamber 6 the acid and hydrocarbon form an emulsion 7.

Once the chamber 6 is filled with emulsion 7 the bolt 5 moves forward and seals the nozzles 3 and 4. After the forward movement the LPG would be as shown in FIG. 2. An alternative would be that the bolt does not move forward but rather nozzles 3 and 4 are sealed by other mechanical means. The emulsion 7 is ignited by a spark ignition device 8 in the bolt. Location of the spark device elsewhere is feasible.

The bipropellant mixture used in the LPG system would contain nitric acid and hydrocarbon in a range of volume ratios of about 1.5 to about 5.0. The acid can contain at least about 70 weight percent nitric acid. The products of combustion would principally consist of nitrogen, hydrogen, oxygen, water, carbon dioxide and carbon monoxide.

At the present time a range of tentative specifications on the hydrocarbon used in a LPG system are as follows:

| | |
|---|---|
| freezing point | −60°F to −40°F (Max) |
| viscosity at −40°F | 60 to 100 centipoise (Max) |
| flash point | 130°F to 140°F (Min) |

and stability towards aqueous nitric acid particularly in the aforementioned range.

The applicants have found that the following hydrocarbons or certain hydrocarbon mixtures meet the foregoing specifications. The structures of these hydrocarbons are given hereinafter. The first structures shown are the tetrahydrodicyclopentadienes, the one to the left is the exo form. The characteristic of this form is that both the methylene bridge in the bicycloheptane system and the trimethylene ring attached thereto are oriented more or less in the same direction. Thus, as shown, both are pointed toward the top of the page. The form to the right is the endo form, here the methylene bridge and the trimethylene ring are oriented in the opposite direction. Thus, as shown the trimethylene ring is pointed toward the bottom of the page, the methylene bridge is pointed toward the top of the page.

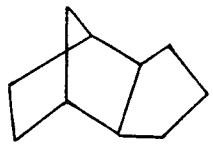

Exo

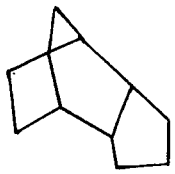

Endo

The methyl group of either exo or endo tetrahydromethyldicyclopentadiene can be located generally anywhere on the ring; the same holds for the two methyls of the tetrahydrodimethyldicyclopentadienes and the ethyl group of tetrahydroethyldicyclopentadienes.

The structural formulas for the other suitable hydrocarbons are as follows:

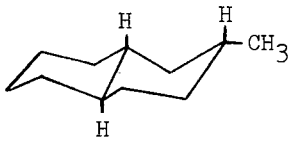

trans-syn-2-methyldecalin

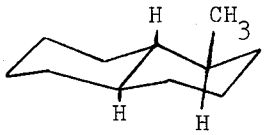

trans-anti-1-methyldecalin

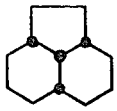

trans-perhydroacenaphthene

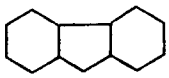

perhydrofluorene

For the perhydroacenaphthene the solid circles represent hydrogens which are facing the reader whereas the other circle represents a hydrogen facing on the other side. The perhydrofluorene formula includes several isomers.

The foregoing discussion mentions the exo and endo structure of a particular compound. The most preferable material would be the 100% exo form. However, because of economic considerations it might be advantageous to use less than 100%. Thus a mixture of exo and endo hydrocarbons wherein the exo form made up at least a majority (i.e., an excess of 50%) of the volume of the hydrocarbon would be operable. A more preferable material would contain at least 75% of the exo structure, a still more preferable material would contain at least 90% of the exo structure. The larger the content of exo structure the smaller is the tendency of the whole mixture to react with nitric acid prior to passage of the igniting spark.

The invention claimed is:

1. In a liquid propellant gun system wherein an emulsion of a liquid hydrocarbon and nitric acid is employed in the breech of a gun behind the projectile, the improvement comprises that the hydrocarbon is selected from the group consisting of a. exo-tetrahydrodicyclopentadiene;
b. a mixture of a major amount of (*a*) and a minor amount of its endo form;
c. exo-tetrahydrodimethyldicyclopentadiene;
d. a mixture of a major amount of (*c*) and a minor amount of its endo form;
e. exo-tetrahydromethyldicyclopentadiene;
f. a mixture of a major amount of (*e*) and a minor amount of its endo form;
g. exo-tetrahydroethyldicyclopentadiene;
h. a mixture of a major amount of (*g*) and a minor amount of its endo form;
i. a mixture of trans-syn-2-methyldecalin and trans-anti-1-methyldecalin;
j. trans-perhydroacenaphthene;
k. perhydrofluorene; and
l. a mixture of any of the foregoing.

2. Improvement according to claim 1 wherein the mixtures of exo and endo hydrocarbons contain at least 75% of the exo form.

3. Improvement according to claim 1 wherein the mixtures of exo and endo hydrocarbons contain at least 90% of the exo form.

* * * * *